US010276088B2

(12) United States Patent
LI et al.

(10) Patent No.: US 10,276,088 B2
(45) Date of Patent: Apr. 30, 2019

(54) PIXEL ARRAY STRUCTURE

(71) Applicant: AU OPTRONICS CORPORATION, Hsin-chu (TW)

(72) Inventors: Chang-Yi LI, Hsin-chu (TW); Yu-Sheng Huang, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/858,111

(22) Filed: Dec. 29, 2017

(65) Prior Publication Data

US 2018/0190182 A1 Jul. 5, 2018

(30) Foreign Application Priority Data

Jan. 4, 2017 (TW) ..... 106100214 A

(51) Int. Cl.
*G09G 3/22* (2006.01)

(52) U.S. Cl.
CPC ..... *G09G 3/22* (2013.01); *G09G 2300/0439* (2013.01); *G09G 2370/16* (2013.01)

(58) Field of Classification Search
CPC ..... G09G 3/22; G09G 2300/0439; G09G 2370/16; G06F 3/046
See application file for complete search history.

(56) References Cited

U.S. PATENT DOCUMENTS 7,463,226 B2 12/2008 Wakita
2004/0041800 A1* 3/2004 Daniels ..... G06F 1/1601 345/204
2008/0258793 A1* 10/2008 Endo ..... G06K 19/0705 327/292
2009/0167739 A1* 7/2009 Tsubata ..... G09G 3/3659 345/208
2014/0080411 A1* 3/2014 Konanur ..... H04B 5/0031 455/41.1
2015/0372541 A1 12/2015 Guo et al.
2016/0189670 A1* 6/2016 Kim ..... G09G 5/02 345/690

FOREIGN PATENT DOCUMENTS

CN 102419674 A * 4/2012
CN 105514623 A 4/2016

OTHER PUBLICATIONS

Office Action issued by (TIPO) Intellectual Property Office, Ministry of Economic Affairs, R. O. C. dated Jun. 1, 2017 for Application No. 106100214, Taiwan.

* cited by examiner

*Primary Examiner* — Mark Edwards
(74) *Attorney, Agent, or Firm* — Tim Tingkang Xia, Esq.; Locke Lord LLP

(57) ABSTRACT

A pixel array structure includes a plurality of scanning lines and a plurality of pixel blocks. Each pixel block includes a plurality of data lines, a plurality of pixel units, a wireless receiving unit, and a position selection unit. The plurality of pixel units is arranged in an array form, and each pixel unit is coupled to one of the plurality of scanning lines and one of the plurality of data lines. The wireless receiving unit receives a data signal in a wireless manner. The position selection unit transmits the data signal to one of the plurality of data lines according to a position selection signal.

14 Claims, 12 Drawing Sheets

PIXEL ARRAY STRUCTURE

CROSS-REFERENCE TO RELATED PATENT APPLICATION

This non-provisional application claims priority to and the benefit of, pursuant to 35 U.S.C. § 119(a), patent application Serial No. 106100214 filed in Taiwan on Jan. 4, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a pixel array structure, and in particular, to a pixel array structure having a wireless receiving function.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In recent years, to be free from a visual limitation of a border, an integration technology that can directly manufacture a gate drive circuit on a display panel has been developed, so that two sides of the display panel are not occupied by gate drive wafers any more, thereby achieving the objective of a slim border. The integration technology is generally called a GOA (gate driver on array) technology.

It is known that a driving capacity of a gate drive circuit manufactured on a display panel by using the GOA technology is weaker than that of a conventional gate drive wafer, and the problem is more serious under a loading condition of a large-size display panel, and consequently, a reliability problem occurs to the display panel. To improve the driving capability problem, later on, a person skilled in the art divides a display panel into a plurality of display areas, and drives, in a block driving manner, each display area to display.

However, a display panel driven in a block driving manner has the problem of insufficient charging and discharging time under a condition of high resolution, for example, resolution of 16K, and therefore the display panel needs to use more data lines, and consequently, an aperture opening ratio of the display panel decreases.

SUMMARY

In an embodiment, a pixel array structure comprises a plurality of scanning lines and a plurality of pixel blocks. Each pixel block comprises a plurality of data lines, a plurality of pixel units, a wireless receiving unit, and a position selection unit. The plurality of pixel units may be arranged in an array form, and each pixel unit is coupled to one of the plurality of scanning lines and one of the plurality of data lines. The wireless receiving unit may receive a data signal in a wireless manner. The position selection unit is coupled between the wireless receiving unit and the plurality of data lines. The position selection unit may transmit the data signal to one of the plurality of data lines according to a position selection signal.

In an embodiment, a pixel array structure comprises a plurality of scanning lines, a plurality of data lines, a plurality of pixel units, and a plurality of first receiving units. The plurality of pixel units is arranged in an array form, and each pixel unit is coupled to one of the plurality of scanning lines and one of the plurality of data lines. The plurality of first receiving units are respectively coupled to the plurality of data lines, and the plurality of first receiving units respectively receives a plurality of data signals in a wireless manner by using different receiving bands.

Based on the above, the pixel array structure of embodiments of the present invention is applied to a display panel. Herein, the pixel array structure of the embodiments of the present invention can receive various data signals needed by various pixel units in corresponding pixel blocks by using various wireless receiving units in a wireless manner, so that the data signals needed by the various pixel blocks are not affected by an excessively large quantity of impedances. In addition, a pixel array apparatus of the embodiments of the present invention does not need to be additionally provided with data lines, and an aperture opening ratio thereof is still not affected after a display panel is manufactured subsequently, and the problem of insufficient placing space of data lines can also be improved. In some embodiments, the pixel array apparatus of the embodiments of the present invention can divide a display image of the display panel into a plurality of display areas, which can be updated at the same time, to increase consistency of the image. In some embodiments, according to the pixel array apparatus of the embodiments of the present invention, the display panel may not be provided with any driver integrated circuit (that is, a data drive circuit and/or a gate drive circuit), or a quantity of driver integrated circuits provided on the display panel is reduced, so as to implement a design of a slim border.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
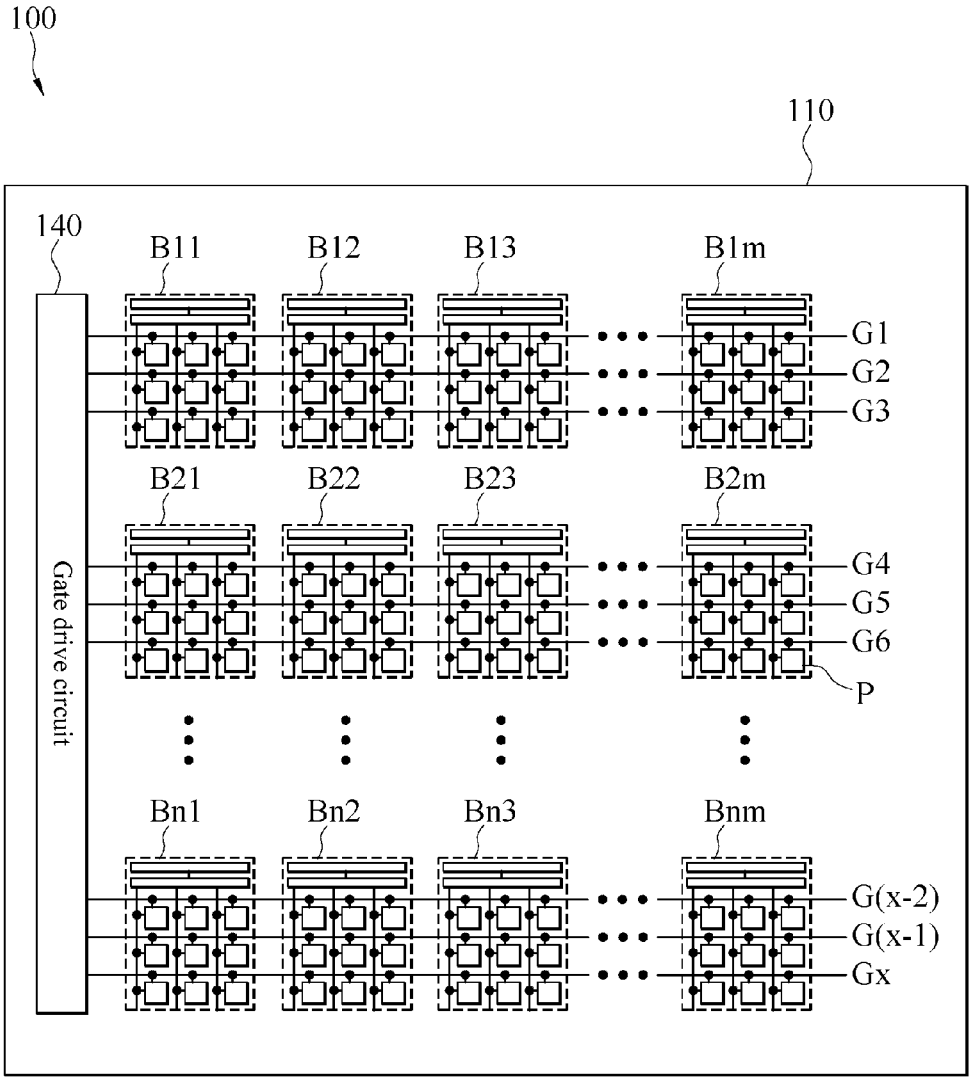
FIG. 1 is a schematic general view of a first embodiment of a pixel array structure.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

FIG. 1 is a schematic general view of a first embodiment of a pixel array structure. Referring to FIG. 1, a pixel array structure 100 comprises a plurality of scanning lines G1-Gx and a plurality of pixel blocks B11-Bnm arranged in an array form. Herein, the scanning lines G1-Gx are divided into a plurality of groups of scanning lines (G1-G3/G4-G6/G(x−2)-Gx). Each pixel block (any one of B11-Bnm) is coupled to a group of scanning lines (G1-G3/G4-G6/G(x−2)-Gx). Pixel blocks B11-B1*m*/B21-B2*m*/Bn1-Bnm in a same row (that is, along extension directions of the scanning lines G1-Gx) may be coupled to a same group of scanning lines (G1-G3/G4-G6/G(x−2)-Gx), wherein n, m, x, and y are all positive integers; n is less than x, and m is less than y.

In an embodiment, the pixel array structure 100 may further comprise a substrate 110, and the scanning lines G1-Gx and the pixel blocks B11-B23 are all configured on the substrate 110. In addition, the pixel array structure 100 may further comprise a gate drive circuit 140, which is also disposed on the substrate 110. The gate drive circuit 140 is coupled to one end of the scanning lines G1-Gx. In addition, in a display process, the gate drive circuit 140 provides scanning signals to the corresponding pixel blocks B11-Bnm via the scanning lines G1-Gx.

Inner architectures of the pixel blocks (any one of B11-Bnm) are approximately the same. Although FIG. 1 shows that each pixel block (any one of B11-Bnm) has 9 pixel units P, the number is not intended to limit the present invention. In other words, each pixel block (any one of B11-Bnm) may have i*j pixel units P1*j*-Pij, wherein j is equal to a number of data lines D1-Dj in the pixel block B11, and i is equal to a number of scanning lines G1-Gi in each group; i is a positive integer less than n and less than x, and j is a positive integer less than m and less than y.

For ease of description, description is made below by using a pixel block B11 in which i=3 and j=3 as an example.

Figure 2:
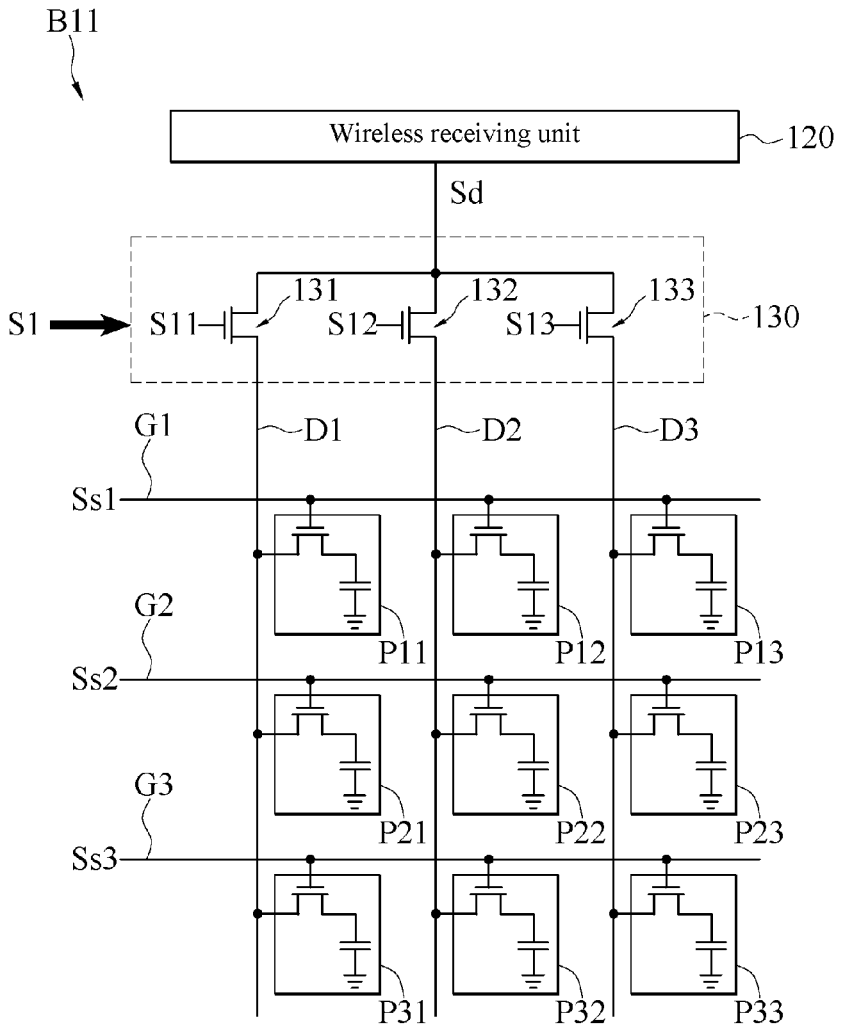
FIG. 2 is a schematic general view of an embodiment of a pixel block in FIG. 1.
Figure 3:
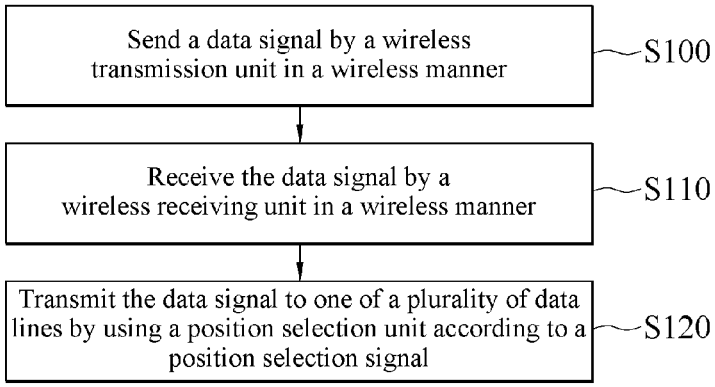
FIG. 3 is a schematic flowchart of an embodiment of a method for driving a pixel block.

FIG. 2 is a schematic general view of an embodiment of a pixel block in FIG. 1, and FIG. 3 is a schematic flowchart of an embodiment of a method for driving a pixel block. Referring to FIG. 1 to FIG. 3, the pixel block B11 comprises a plurality of data lines D1-D3, a plurality of pixel units P11-P33, a wireless receiving unit 120, and a position selection unit 130.

The plurality of data lines D1-D3 is configured on the substrate 110, and intersects with the plurality of scanning lines G1-G3. The plurality of pixel units P11-P33 is arranged in an array form, and each of the pixel units P11-P33 is coupled to one of the plurality of scanning lines G1-G3 and one of the plurality of data lines D1-D3. The position selection unit 130 is coupled between the plurality of data lines D1-D3 and the wireless receiving unit 120.

The pixel block B11 may sequentially receive a data signal Sd of each data line (D1, D2, or D3) in a wireless manner by using the wireless receiving unit 120 (step S110), and transmit the data signal Sd to one of the plurality of data lines D1-D3 according to a position selection signal S1 by using the position selection unit 130 (step S120), so that when one of the plurality of pixel units P11-P33 is driven according to scanning signals Ss1-Ss3 transmitted by the scanning lines G1-G3, the pixel unit can load the corresponding data signal Sd via the coupled data lines D1-D3, so as to display a corresponding gray scale according to the data signal Sd. For example, when the scanning line G1 drives the pixel units P11-P13 by using the scanning signal Ss1, the wireless receiving unit 120 sequentially receives three data signals Sd, and the position selection unit 130 sequentially conducts the wireless receiving unit 120 to the data lines D1-D3 (that is, one of the data lines D1-D3 is conducted, but the remaining two data lines are not conducted), so that a first signal of the received three data signals Sd is loaded into the pixel unit P11 via the data line D1, a second signal of the received three data signals Sd is loaded into the pixel unit P12 via the data line D2, and a third signal of the received three data signals Sd is loaded into the pixel unit P13 via the data line D3. When the scanning line G2 drives the pixel units P21-P23 by using the scanning signal Ss2, the wireless receiving unit 120 sequentially receives three data signals Sd again, and the position selection unit 130 sequentially conducts the wireless receiving unit 120 to the data lines D1-D3 repeatedly, so that a first signal of the three data signals Sd received again is loaded into the pixel unit P21 via the data line D1, a second signal of the three data signals Sd received again is loaded into the pixel unit P22 via the data line D2, and a third signal of the three data signals Sd received again is loaded into the pixel unit P23 via the data line D3. In addition, such analogy is performed.

In some embodiments, the pixel blocks B11-Bnm in different rows may share same groups of the scanning signals Ss1-Ss3. For example, scanning lines G1 and G4 may be used to transmit a same scanning signal Ss1; scanning lines G2 and G5 may be used to transmit a same scanning signal Ss2; and the scanning lines G3 and G6 may be used to transmit a same scanning signal Ss3. In other words, for the pixel blocks B11-Bnm in different rows, scanning lines G1, G4/G2, G5/G3, and G6 at same corresponding positions can be coupled to a same signal source (for example, a same pin of the gate drive circuit 140). For example, first scanning lines G1 and G4 coupled to the pixel blocks B11-Bnm in different rows are coupled to a same signal source, and second scanning lines G2 and G5 coupled to the pixel blocks B11-Bnm in different rows are coupled to a same signal source. In addition, such analogy is performed.

In some embodiments, the position selection unit 130 may be implemented by using a one-to-many multiplexer. However, in some other embodiments, the position selection unit 130 may comprise a plurality of switch modules 131-133, and the switch modules 131-133 respectively correspond to the data lines D1-D3. The switch modules 131/132/133 are coupled between the wireless receiving unit 120 and the corresponding data lines D1/D2/D3. In addition, the position selection signal S1 may comprise a plurality of selected signals S11-S13, and the selected signals S11-S13 are respectively provided to the switch modules 131-133. The switch modules 131/132/133 conduct the wireless receiving unit 120 to the corresponding data lines D1/D2/D3 according to the corresponding selected signals S11/S12/S13, so that the data signal Sd can be transmitted to the corresponding data lines D1/D2/D3. It should be noted that, at a same time point, only one of the plurality of switch modules 131-133 can be conducted. For example, when the selected signal S11 is a high level so that the switch module 131 is conducted, the remaining selected signals S12-S13 are low levels so that the switch modules 132-133 are not conducted.

In some embodiments, the pixel blocks B11-B23 may share the position selection signals S11-S13, so that the pixel units P11-P33 located at same corresponding positions in the pixel blocks B11-B23 (for example, a first pixel unit P11 located in a first row of the pixel blocks B11-B23) can be synchronously conducted to respective wireless receiving units 120. In other words, the pixel blocks B11-B23 can operate at the same time.

In an embodiment of step S110, the wireless receiving unit 120 may obtain the data signal Sd in a wireless sensing manner, for example, by means of electromagnetic induction, but the present invention is not limited thereto. In some embodiments, an amplitude size of a radio frequency signal (the data signal Sd) received by the wireless receiving unit 120 may be used to represent a gray scale value displayed by a corresponding pixel unit.

In some embodiments, in the pixel array structure 100, the wireless receiving units 120 in all or some of the pixel blocks B11-B23 can receive the data signal Sd wirelessly at the same time. Therefore, the wireless receiving units 120 in a plurality of adjacent pixel blocks in the pixel blocks B11-B23 or all the pixel blocks B11-B23 receive the data signal Sd wirelessly by using receiving bands with different center frequencies, to reduce mutual interference between signals. In some embodiments, bandwidths of receiving bands with different center frequencies may be bandwidths of the receiving bands when the receiving bands are separated from each other (non-overlapping) or overlapping with each other, and are less than or equal to half of a bandwidth of a complete band.

In the embodiments, the wireless receiving unit 120 and the position selection unit 130 in each of the pixel blocks (any one of B11-Bnm) can replace a conventional data drive circuit to provide the data signal Sd to corresponding data lines D1-Dy. In some embodiments, the substrate 110 may not be provided with a data drive circuit.

In some embodiments, the wireless receiving units 120 of the pixel blocks B11-Bnm correspond to one or more wireless transmission units (that is, bands with same center frequencies are supported), and each of the wireless transmission units is coupled to a data drive circuit. Herein, one wireless transmission unit corresponds to one or more wireless receiving units 120. Each of the wireless transmission units receives the data signal Sd output by the data drive circuit, and sends the data signal Sd to a corresponding wireless receiving unit 120 in a wireless manner (Step S100). In other words, in step S100, the wireless transmission unit may perform wireless sensing with the corresponding wireless receiving unit 120, so that the corresponding wireless receiving unit 120 can receive the data signal Sd.

In some embodiments, the wireless transmission unit may transmit the data signal Sd to the wireless receiving units 120 of the pixel blocks B11-Bnm in a one-to-one manner. In some other embodiments, the wireless transmission unit may transmit the data signal Sd to the wireless receiving units 120 of the pixel blocks B11-Bnm in a one-to-many manner. Herein, when one wireless transmission unit corresponds to a plurality of wireless receiving units 120, a transmission band of the wireless transmission unit covers receiving bands of the corresponding plurality of wireless receiving units 120.

In some embodiments, the wireless transmission unit may be disposed on another substrate different from the substrate 110. The wireless transmission units are coupled to a data drive circuit that is also disposed on another substrate. For example, the wireless receiving unit 120 is configured on a display panel (the pixel array structure 100), and a wireless transmission unit corresponding thereto is configured on a backlight module configured to provide a light source of the display panel.

Figure 4:
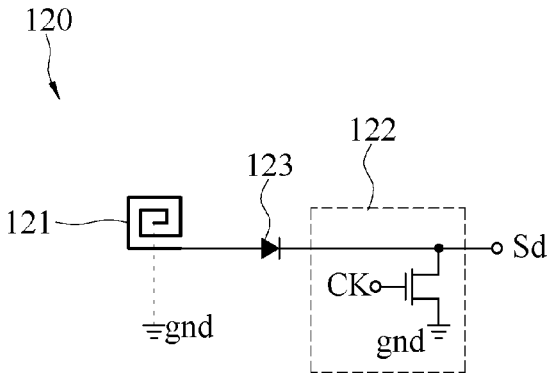
FIG. 4 is a schematic general view of a first embodiment of a wireless receiving unit in FIG. 2.

FIG. 4 is a schematic general view of a first embodiment of the wireless receiving unit 120 in FIG. 2. Referring to FIG. 1 to FIG. 4, in an embodiment, the wireless receiving unit 120 may comprise an antenna (called a first antenna 121 below) and a resetting unit 122. The resetting unit 122 is coupled between the first antenna 121 and the position selection unit 130.

The first antenna 121 may sense and receive a data signal Sd by using a first receiving band. The resetting unit 122 may receive and be controlled by a clock signal CK, to reset, according to the clock signal CK, the data signal Sd received by the first antenna 121.

Figure 5:
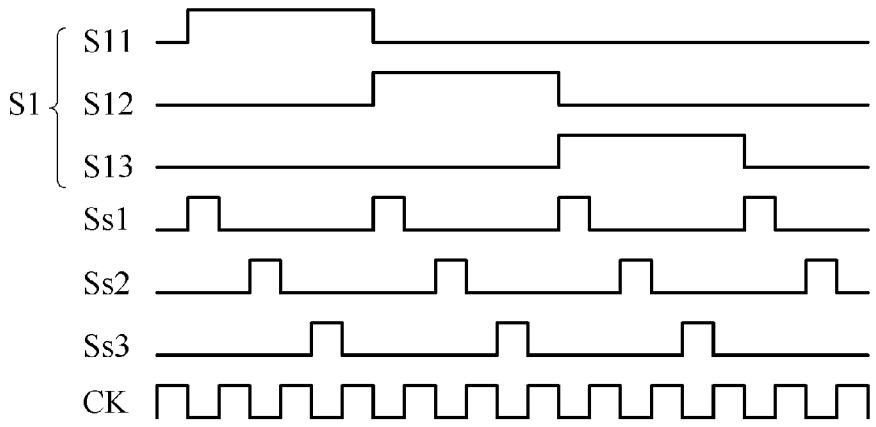
FIG. 5 is a schematic general view of a position selection signal, a scanning signal, and a clock signal.

FIG. 5 is a schematic general view of a position selection signal, a scanning signal, and a clock signal. Referring to FIG. 1 to FIG. 5, in an embodiment, a clock signal CK may be a pulse wave signal with a fixed period and a fixed pulse beam width, and the pulse wave signal has a conduction period and a turn-off period. The resetting unit 122 may stop action in the turn-off period of the clock signal CK, so that the data signal Sd received by the first antenna 121 can be transmitted to the position selection unit 130, and transmitted by the position selection unit 130 to the corresponding data lines D1-D3 according to the position selection signal S1. In addition, the resetting unit 122 may remove, in the conduction period of the clock signal, the data signal Sd transmitted, at a previous time point by the first antenna 121, to the position selection unit 130, to prevent the first antenna 121 from being affecting by the data signal Sd of the previous time point when the first antenna 121 transmits the received data signal Sd to the position selection unit 130 at a next time point, so as to reduce errors.

It should be noted that, in FIG. 5, a conduction period of each signal is indicated by a high level, and a turn-off period of each signal is indicated by a low level, but the present invention is not limited thereto.

In some embodiments, the resetting unit 122 may be a switch module. A first end of the switch module is coupled to the first antenna 121 and the position selection unit 130, and a second end of the switch module is coupled to a ground voltage gnd. A control end of the switch module is coupled to a clock signal CK, to conduct the first antenna 121 to the ground voltage gnd according to the clock signal CK.

In an embodiment, the data signal Sd received by the wireless receiving unit 120 may be an alternating-current signal. Therefore, the wireless receiving unit 120 may further comprise a rectification unit 123, which is coupled between the first antenna 121 and the resetting unit 122 and coupled between the first antenna 121 and the position selection unit 130. The rectification unit 123 is configured to rectify the data signal Sd received by the first antenna 121, and then output the rectified data signal Sd to the position selection unit 130.

In some embodiments, the rectification unit 123 may be a diode, but the present invention is not limited thereto. The rectification unit 123 may be implemented by any circuit suitable for signal rectification.

In some embodiments, the clock signal CK can be provided to the resetting unit 122 by an upper-level circuit (a signal source) on the substrate 110, that is, the resetting unit 122 is connected to the signal source in a wired manner by using a pull wire to receive the clock signal CK. Further, in some other embodiments, the clock signal CK can receive and provide the resetting unit 122 in a wireless sensing manner.

Figure 6:
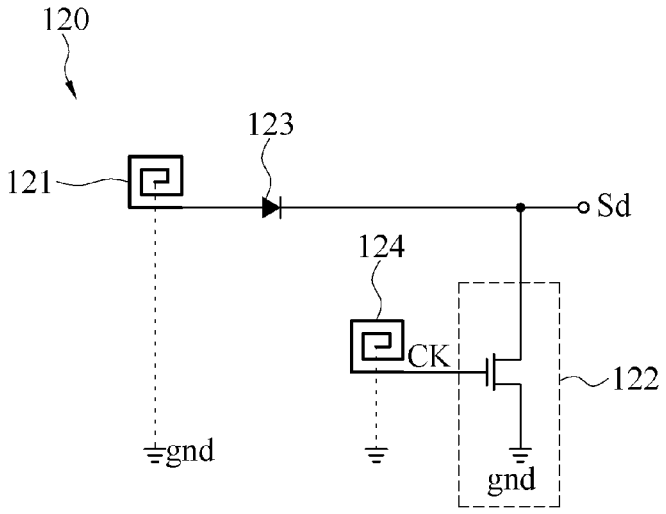
FIG. 6 is a schematic general view of another implementation aspect of a first embodiment of a wireless receiving unit in FIG. 2.

FIG. 6 is a schematic general view of another implementation aspect of the first embodiment of the wireless receiving unit in FIG. 2. Referring to FIG. 1 to FIG. 6, in an implementation aspect, the wireless receiving unit 120 may further comprise another antenna (called a second antenna 124 below), and the second antenna 124 is coupled to a control end of the resetting unit 122. The second antenna 124 may generate and provide the clock signal CK to the resetting unit 122 by using a second receiving band in a wireless sensing manner A center frequency of the second receiving band is different from that of the first receiving band, so that the first antenna 121 and the second antenna 124 do not affect each other. In an embodiment, bandwidths of receiving bands with different center frequencies may be bandwidths of the receiving bands when the receiving bands are separated from each other (non-overlapping) or overlapping with each other, and are less than or equal to half of a bandwidth of a complete band (the first receiving band and the second receiving band) of any antenna.

In some embodiments, a plurality of resetting units 122 may share one second antenna 124, and the shared second antenna 124 provides the clock signal CK. In other words, the pixel array structure 100 may further comprise one or more second antennas 124 (a total quantity is less than a total quantity of the pixel blocks B11-Bnm). The second antennas 124 are coupled to control ends of the plurality of resetting units 122. The second antenna 124 generates and provides the clock signal CK to the coupled plurality of resetting units 122 by using a second receiving band in a wireless sensing manner. In some embodiments, all the resetting units 122 of the pixel blocks B11-Bnm can share a same second antenna 124. In some other embodiments, more than two second antennas 124 can provide the clock signal CK to all the resetting units 122 of the pixel blocks B11-Bnm. To facilitate wiring, the second antennas 124 may be coupled to the resetting units 122 in adjacent pixel blocks (a plurality of adjacent pixel blocks in B11-Bnm).

In some embodiments, a central tap end of the first antenna 121 and a central tap end of the second antenna 124 may be coupled to the ground voltage gnd, but the present invention is not limited thereto.

Figure 7:
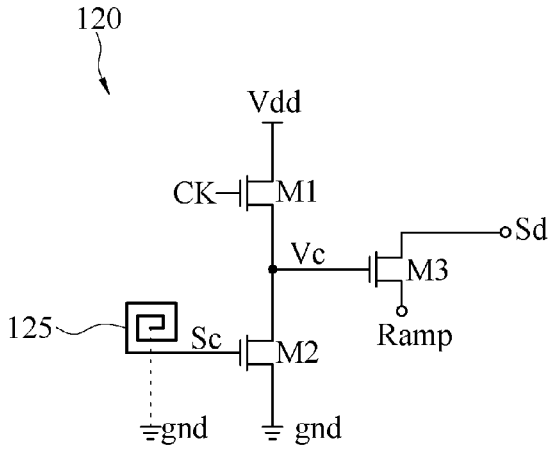
FIG. 7 is a schematic general view of a second embodiment of a wireless receiving unit in FIG. 2.
Figure 8:
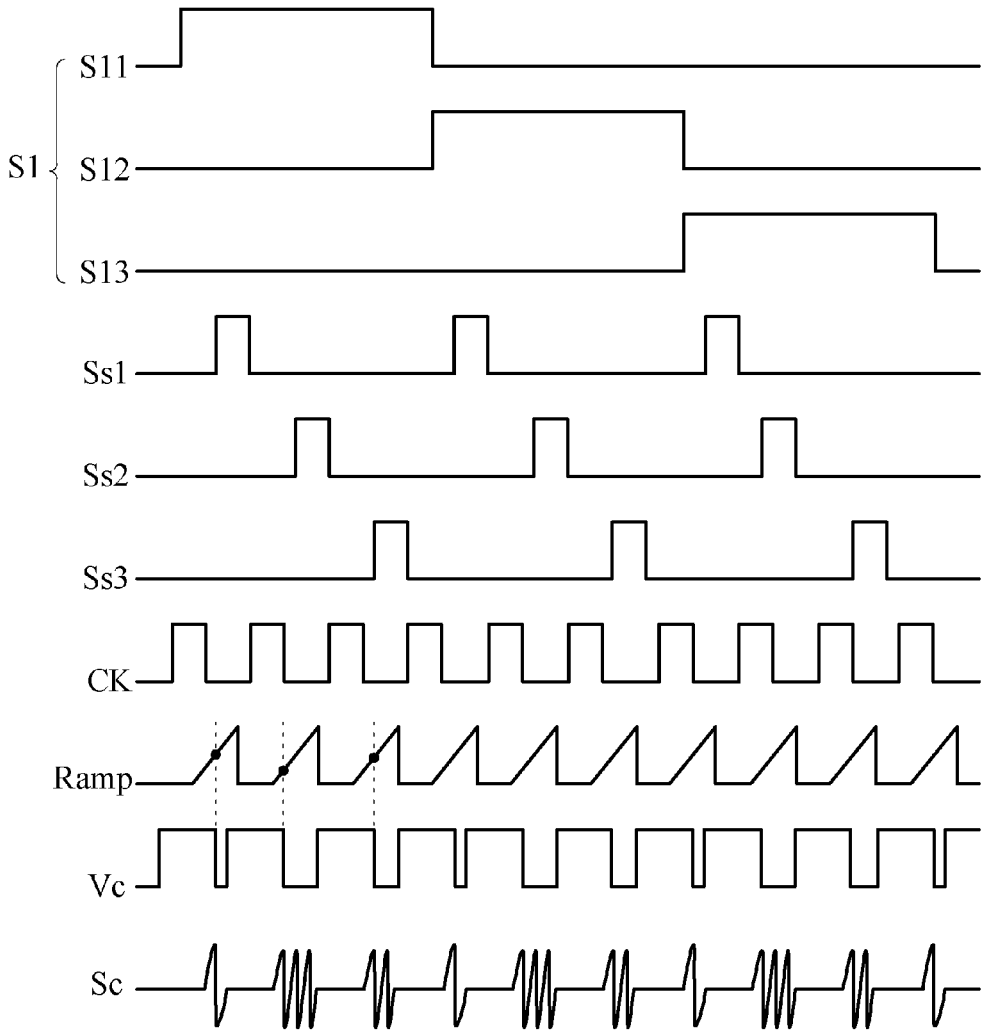
FIG. 8 is a schematic general view of a position selection signal, a scanning signal, a clock signal, a ramp voltage, and a control signal.

FIG. 7 is a schematic general view of a second embodiment of the wireless receiving unit in FIG. 2, and FIG. 8 is a schematic general view of a position selection signal, a scanning signal, a clock signal, a ramp voltage, and a control signal. Referring to FIG. 1 to FIG. 8, in another embodiment, the wireless receiving unit 120 may comprise at least one antenna (called a first antenna 125 below) and at least three transistors (called a first transistor M1, a second transistor M2, and a third transistor M3 below).

A first end of the first transistor M1 is coupled to a power supply voltage Vdd, and a control end of the first transistor M1 is coupled to a clock signal CK. A second end of the second transistor M2 is coupled to a ground voltage gnd, and a control end of the second transistor M2 is coupled to the first antenna 125. A second end of the first transistor M1 and a first end of the second transistor M2 are connected to each other to a control end of the third transistor M3. A joint between the second end of the first transistor M1 and the first end of the second transistor M2 outputs a control signal Vc to the control end of the third transistor M3. A first end of the third transistor M3 is coupled to a position selection unit 130, and a second end of the third transistor M3 is coupled to a ramp voltage Ramp. The first end of the third transistor M3 outputs a data signal Sd to the position selection unit 130.

The first antenna 125 receives a truncated signal Sc by using a first receiving band in a wireless manner. The third transistor M3 is controlled by the clock signal CK and generates a corresponding data signal Sd according to the truncated signal Sc and the ramp voltage Ramp. In an embodiment, the first transistor M1 may be conducted according to the clock signal, so that the power supply voltage Vdd may charge the control end of the third transistor M3 via the first transistor M1, so as to pull up a level of the control end (the control signal Vc) of the third transistor M3 to a high level. In addition, the ramp voltage Ramp may charge the second end of the third transistor M3 by using a charging slope, so as to gradually pull up a level of the second end of the third transistor M3. After the first antenna 125 receives the truncated signal Sc in a wireless manner to conduct the second transistor M2, the level of the control end (the control signal Vc) of the third transistor M3 is pulled down to a low level, and the control signal Vc generated by the first transistor M1 and the second transistor M2 makes the third transistor M3 generate the corresponding data signal Sd to the position selection unit 130 according to a level of the ramp voltage Ramp truncated by the control signal Vc.

In some embodiments, the clock signal CK can be provided to the first transistor M1 by an upper-level circuit (a signal source) on a substrate 110, that is, the control end of the first transistor M1 is connected to the signal source in a wired manner by using a pull wire to receive the clock signal CK. Further, in some other embodiments, the clock signal CK can receive and provide the first transistor M1 in a wireless sensing manner.

Figure 9:
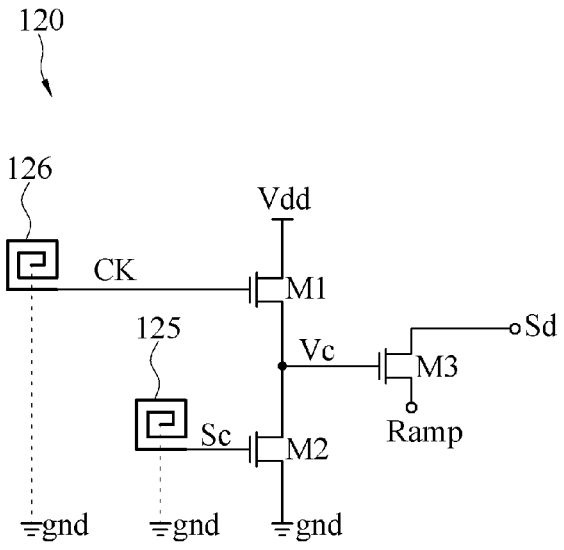
FIG. 9 is a schematic general view of another implementation aspect of a second embodiment of a wireless receiving unit in FIG. 2.

FIG. 9 is a schematic general view of another implementation aspect of the second embodiment of the wireless receiving unit in FIG. 2. Referring to FIG. 1 to FIG. 9, in an implementation aspect, the wireless receiving unit 120 may further comprise another antenna (called a second antenna 126 below), and the second antenna 126 is coupled to the control end of the first transistor M1. The second antenna 126 may generate the clock signal CK to the first transistor M1 by using the second receiving band in a wireless sensing manner. A center frequency of the second receiving band is different from that of the first receiving band, so that the first antenna 125 and the second antenna 126 do not affect each other. In an embodiment, bandwidths of receiving bands with different center frequencies may be bandwidths of the receiving bands when the receiving bands are separated from each other (non-overlapping) or overlapping with each other, and are less than or equal to half of a bandwidth of a complete band (the first receiving band and the second receiving band) of any antenna.

In some embodiments, neither the center frequency of the first receiving band used by the first antenna 121 (or 125) nor the center frequency of the second receiving band used by the second antenna 124 (or 126) is greater than an operating frequency of the pixel units P11-P33, for example, not greater than 13.56 MHz (megahertz).

In some embodiments, the wireless receiving units 120 of the pixel blocks B11-Bnm may respectively receive wireless signals (data signals Sd in a radio frequency form) by using receiving bands different from each other. In other words, center frequencies of receiving bands used by the wireless receiving units 120 of the pixel blocks (B11-Bnm) are different from each other, to prevent one from affecting another. However, the present invention is not limited thereto. In some other embodiments, the wireless receiving units 120 of a plurality of adjacent pixel blocks (a plurality of adjacent pixel blocks in B11-Bnm) receive wireless signals by using receiving bands different from each other. However, when a distance between two pixel blocks is far enough, the wireless receiving units 120 of the two pixel blocks can receive the wireless signals by using a same receiving band, that is, center frequencies of receiving bands used by the wireless receiving units 120 are the same as each other or a distance between two centre frequencies is not greater than half of any one of the two receiving bands.

Figure 10:
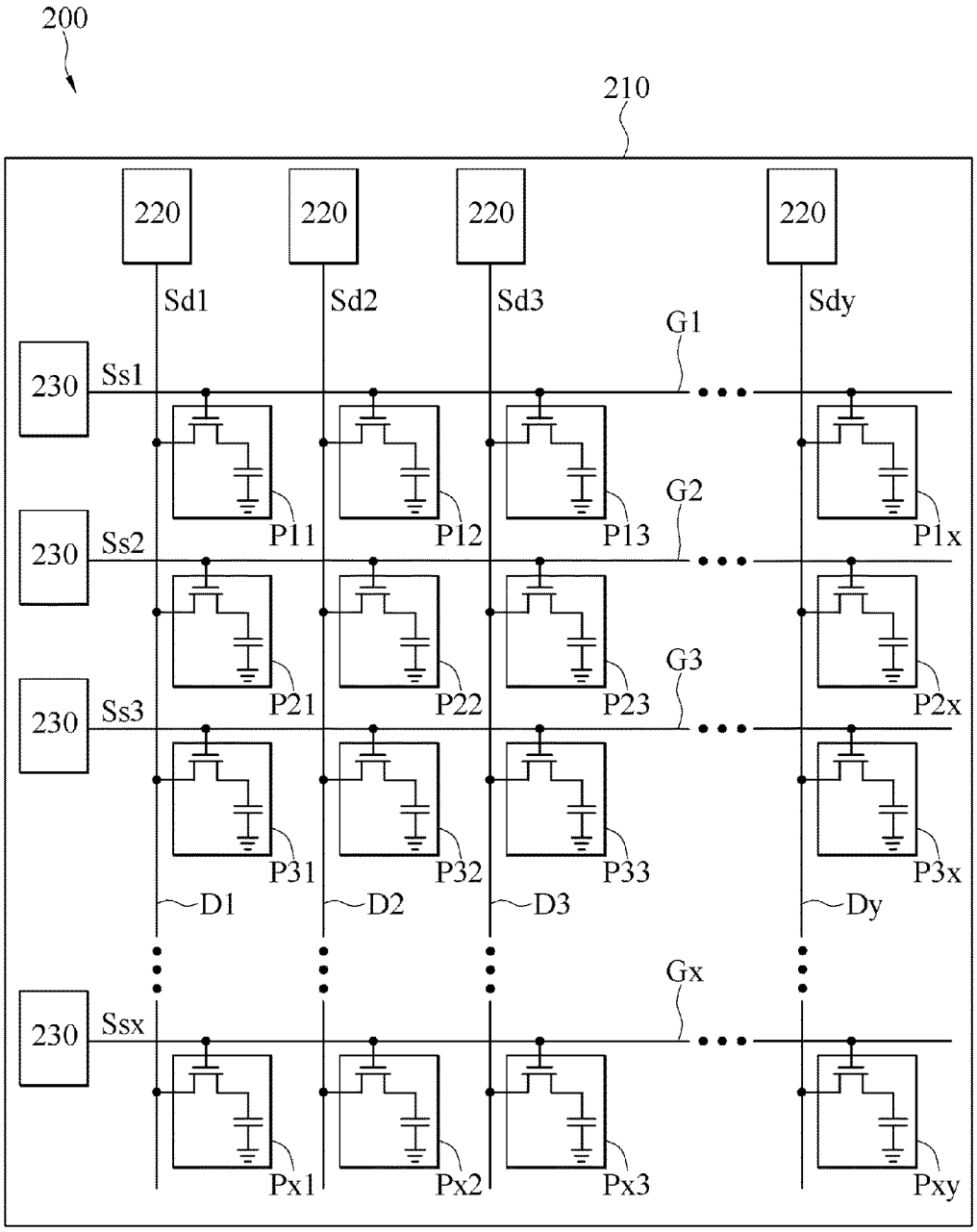
FIG. 10 is a schematic general view of a second embodiment of a pixel array structure.

FIG. 10 is a schematic general view of a second embodiment of a pixel array structure. Referring to FIG. 10, in this embodiment, a pixel array structure 200 comprises a plurality of scanning lines G1-Gx, a plurality of data lines D1-Dy, a plurality of pixel units P11-Pxy (called P in general), and a plurality of first receiving units 220. The scanning lines G1-Gx intersect with the data lines D1-Dy, to define a plurality of pixel positions. The pixel units P11-Pxy are arranged in an array form and are respectively located at the pixel positions. Each pixel unit (any one of P11-P13) is coupled to one of a plurality of scanning lines G1-G3 and one of a plurality of data lines D1-D3. Each of first receiving units 220*a*-220*c* is coupled to one of the plurality of data lines D1-D3.

In an embodiment, the pixel array structure 200 may further comprise a substrate 210. The plurality of scanning lines G1-Gx is configured on the substrate 210. The plurality of data lines D1-Dy is configured on the substrate 210, and the plurality of pixel units P11-Pxy is configured on the substrate 210 in an array form.

In some embodiments, the first receiving units 220 receive respective corresponding data signals Sd1-Sdy by using receiving bands different from each other in a wireless manner, and provide the data signals Sd1-Sdy to respective corresponding data lines D1-D3. In other words, center frequencies of the receiving bands used by the first receiving units 220 are different from each other, so that the first receiving units 220 do not affect each other. In some other embodiments, a plurality of adjacent first receiving units 220 receives respective corresponding data signals by using receiving bands different from each other in a wireless manner. However, when a distance between two first receiving units 220 is far enough, the two first receiving units 220 can receive respective corresponding data signals by using a same receiving band in a wireless manner, that is, center frequencies of receiving bands used by the first receiving units 220 are the same as each other or a distance between two centre frequencies is not greater than half of any one of the two receiving bands. In some embodiments, bandwidths of receiving bands with different center frequencies may be bandwidths of the receiving bands when the receiving bands are separated from each other (non-overlapping) or overlapping with each other, and are less than or equal to half of a bandwidth of a complete band.

In the embodiments, the first receiving units 220 can replace a conventional data drive circuit to provide the data signals Sd1-Sdy to the corresponding data lines D1-Dy. In some embodiments, the substrate 210 may not be provided with a data drive circuit.

In some embodiments, the first receiving units 220 correspond to one or more wireless transmission units (that is, bands with same center frequencies are supported), and each of the wireless transmission units 120 is coupled to a data drive circuit. Herein, one wireless transmission unit may correspond to one or more first receiving units 220. The wireless transmission units receive the data signals Sd1-Sdy output by the data drive circuit, and send the data signals Sd1-Sdy to the corresponding first receiving units 220 in a wireless manner. In other words, the wireless transmission units may perform wireless sensing with the corresponding wireless receiving units 220, so that the corresponding first receiving units 220 can receive the data signal Sd1-Sdy.

In some embodiments, the wireless transmission units may transmit the data signals Sd1-Sdy to the corresponding first receiving units 220 in a one-to-one manner. In some other embodiments, the wireless transmission units may transmit the data signals Sd1-Sdy to the corresponding first receiving units 220 in a one-to-one manner. Herein, when one wireless transmission unit corresponds to a plurality of first receiving units 220, a transmission band of the wireless transmission unit covers receiving bands of the corresponding plurality of first wireless receiving units 220.

In some embodiments, the wireless transmission units may be provided on another substrate different from the substrate 110. The wireless transmission units are coupled to a data drive circuit that is also disposed on another substrate. For example, the first receiving unit 220 is configured on a display panel (the pixel array structure 200), and a wireless transmission unit corresponding thereto is configured on a backlight module configured to provide a light source of the display panel.

Architectures of the first receiving units 220 are approximately the same, and a first receiving unit 220 coupled to the data line D1 is described below as an example.

Figure 11:
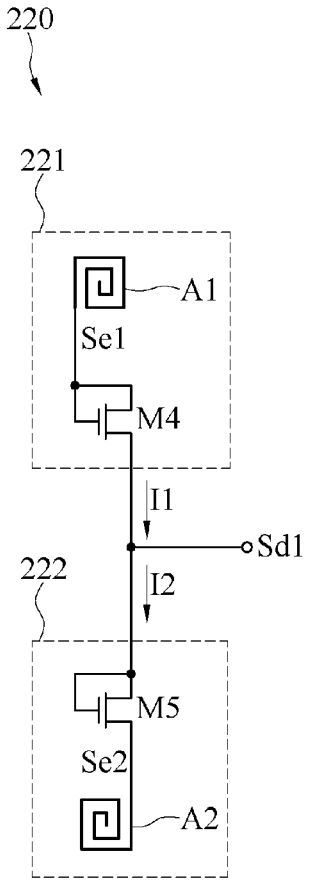
FIG. 11 is a schematic general view of an embodiment of a first receiving unit in FIG. 10.

FIG. 11 is a schematic general view of an embodiment of the first receiving unit in FIG. 10. Referring to FIG. 10 and FIG. 11, in an embodiment, the first receiving unit 220 may comprise a first charging circuit 221 and a first discharging circuit 222. The first charging circuit 221 is coupled to the first discharging circuit 222, and a joint between the first charging circuit 221 and the first discharging circuit 222 is coupled to the corresponding data line D1. The first charging circuit 221 may receive a first sensing signal Se1 in a wireless sensing manner, and generate a first charging signal I1 according to the first sensing signal Se1. The first discharging circuit 222 may receive a second sensing signal Se2 in a wireless sensing manner, and generate a first discharging signal 12 according to the second sensing signal Se2. A data signal Sd1 received by the first receiving unit 220 corresponds to the first charging charge I1 and the first discharging signal 12. The data signal Sd1 provided by the first receiving unit 220 to the data line D1 may be a difference between the first charging signal I1 and the first discharging signal 12.

In some embodiments, in a same first receiving unit 220, a receiving band used by the first charging circuit 221 is different from that used by the first discharging circuit 222, that is, center frequencies of receiving bands are different. In addition, first charging circuits 221 and first discharging circuits 222 of a plurality of adjacent first receiving units 220 also use receiving bands different from each other, that is, center frequencies of receiving bands are different. In some embodiments, bandwidths of receiving bands with different center frequencies may be bandwidths of the receiving bands when the receiving bands are separated from each other (non-overlapping) or overlapping with each other, and are less than or equal to half of a bandwidth of a complete band.

In some embodiments, referring to FIG. 11, the first charging circuit 221 may comprise a first antenna A1 and a first transistor M4. A first end of the first transistor M4 and a control end of the first transistor M4 are coupled to each other and are coupled to the first antenna A1, and a second end of the first transistor M1 is coupled to the corresponding data line D1. In addition, the first discharging circuit 222 may comprise a second antenna A2 and a second transistor M5. A first end of the second transistor M5 is coupled to the second antenna A2, and a second end of the second transistor M5 and a control end of the second transistor M5 are coupled to each other and are coupled to the corresponding data line D1. In other words, the second end and the control end of the second transistor M5 may be connected to the second end of the first transistor M4 to output the data signal Sd1 to the data line D1. In some embodiments, the first antenna A1 and the second antenna A2 of a same first receiving unit 220 use different receiving bands (that is, center frequencies of receiving bands are different), that is, different from receiving bands used by the first antenna A1 and the second antenna A2 of the first receiving unit 220 within a given distance.

Referring back to FIG. 10, the pixel array structure 200 may further comprise a plurality of second receiving units 230, and each second receiving unit 230 is coupled to one of the plurality of scanning lines G1-Gx.

In some embodiments, the second receiving units 230 receive respective corresponding scanning signals Ss1-Ssx by using receiving bands different from each other in a wireless manner, and provide the scanning signals Ss1-Ssx to respective corresponding scanning lines G1-Gx. In other words, center frequencies of the receiving bands used by the second receiving units 230 are different from each other, so that the second receiving units 230 do not affect each other. In some other embodiments, a plurality of adjacent second receiving units 230 receives respective corresponding scanning signals by using receiving bands different from each other in a wireless manner. However, when a distance between two first receiving units 220 is far enough, the two first receiving units 220 can receive respective corresponding data signals by using a same receiving band in a wireless manner, that is, center frequencies of receiving bands used by the first receiving units 220 are the same as each other or a distance between two centre frequencies is not greater than half of any one of the two receiving bands. In some embodiments, bandwidths of receiving bands with different center frequencies may be bandwidths of the receiving bands when the receiving bands are separated from each other (non-overlapping) or overlapping with each other, and are less than or equal to half of a bandwidth of a complete band.

In some embodiments, receiving bands used by the second receiving units 230 and receiving bands used by the first receiving units 220 are different from each other, so as to ensure that the first receiving units 220 and the second receiving units 230 do not affect each other. In some other embodiments, receiving bands used by the first receiving units 220 and receiving bands used by the second receiving units 230 within a given range are different from each other. However, when a distance between any two wireless receiving units in the first receiving units 220 and the second receiving units 230 is far enough, the two wireless receiving units can receive respective corresponding wireless signals (data signals or scanning signals in a radio frequency form) by using a same receiving band in a wireless manner, that is, center frequencies of receiving bands used by the wireless receiving units are the same as each other, or a distance between two center frequencies is not greater than half of any one of two receiving bands. In some embodiments, bandwidths of receiving bands with different center frequencies may be bandwidths of the receiving bands when the receiving bands are separated from each other (non-overlapping) or overlapping with each other, and are less than or equal to half of a bandwidth of a complete band.

In the embodiments, the second receiving units 230 can replace a conventional gate drive circuit to provide the scanning signals Ss1-Ssx to the corresponding scanning lines G1-Gx. In some embodiments, the substrate 210 may not be provided with a gate drive circuit.

In some embodiments, the second receiving units 230 correspond to one or more wireless transmission units (that is, bands with same center frequencies are supported), and each of the wireless transmission units is coupled to a gate drive circuit. Herein, one wireless transmission unit may correspond to one or more second receiving units 230. The wireless transmission units receive the scanning signals Ss1-Ssx output by the data drive circuit, and send the scanning signals Ss1-Ssx to corresponding second receiving units 230 in a wireless manner. In other words, the wireless transmission units may perform wireless sensing with the corresponding second receiving units 230, so that the corresponding second receiving units 230 can receive the scanning signals Ss1-Ssx.

In some embodiments, the wireless transmission units may transmit the scanning signals Ss1-Ssx to the corresponding second receiving units 230 in a one-to-one manner. In some other embodiments, the wireless transmission units may transmit the scanning signals Ss1-Ssx to the corresponding second receiving units 230 in a one-to-one manner. Herein, when one wireless transmission unit corresponds to a plurality of second receiving units 230, a transmission band of the wireless transmission unit covers receiving bands of the corresponding plurality of second receiving units 230.

In some embodiments, the wireless transmission units may be provided on another substrate different from the substrate 110. The wireless transmission units are coupled to a data drive circuit that is also disposed on another substrate. For example, the second receiving unit 230 is configured on a display panel (the pixel array structure 200), and a wireless transmission unit corresponding thereto is configured on a backlight module configured to provide a light source of the display panel.

Architectures of the second receiving units 230 are approximately the same, and a second receiving unit 230*a* coupled to the scanning line G1 is described below as an example.

Figure 12:
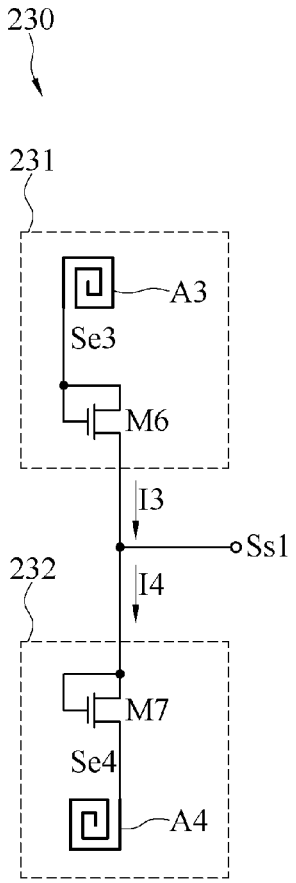
FIG. 12 is a schematic general view of an embodiment of a second receiving unit in FIG. 10.

FIG. 12 is a schematic general view of an embodiment of the second receiving unit in FIG. 10. Referring to FIG. 10 and FIG. 12, in an embodiment, the second receiving unit 230 may comprise a second charging circuit 231 and a second discharging circuit 232. The second charging circuit 231 is coupled to the second discharging circuit 232, and a joint between the second charging circuit 231 and the second discharging circuit 232 is coupled to the corresponding scanning line G1. The second charging circuit 231 may receive a third sensing signal Se3 in a wireless sensing manner, and generate a second charging signal 13 according to the third sensing signal Se3. The second discharging circuit 232 may receive a fourth sensing signal Se4 in a wireless sensing manner, and generate a second discharging signal 14 according to the fourth sensing signal Se4. A scanning signal Ss1 received by the second receiving unit 230 may correspond to the second charging charge 13 and the second discharging signal 14. The scanning signal Ss1 provided by the second receiving unit 230 to the scanning line G1 may be a difference between the first charging signal I1 and the first discharging signal 12.

In some embodiments, in a same second receiving unit 230, a receiving band used by the second charging circuit 231 is different from that used by the second discharging circuit 232, that is, center frequencies of receiving bands are different. In addition, second charging circuits 231 and second discharging circuits 232 of a plurality of adjacent second receiving units 230 also use receiving bands different from each other, that is, center frequencies of receiving bands are different. In some embodiments, bandwidths of receiving bands with different center frequencies may be bandwidths of the receiving bands when the receiving bands are separated from each other (non-overlapping) or overlapping with each other, and are less than or equal to half of a bandwidth of a complete band.

In some embodiments, referring to FIG. 11, the second charging circuit 231 may comprise a third antenna A3 and a third transistor M6. A first end of the third transistor M6 and a control end of the third transistor M6 are coupled to each other and are coupled to the third antenna A3, and a second end of the third transistor M6 is coupled to the corresponding scanning line G1. In addition, the second discharging circuit 232 may comprise a fourth antenna A4 and a fourth transistor M7. A first end of the fourth transistor M7 is coupled to the fourth antenna A4, and a second end of the fourth transistor M7 and a control end of the fourth transistor M7 are coupled to each other and are coupled to the corresponding scanning line G1. In other words, the second end and the control end of the fourth transistor M7 may be connected to the second end of the third transistor M6 to output the scanning signal Ss1 to the scanning line G1. In some embodiments, the third antenna A3 and the fourth antenna A4 of a same second receiving unit 230 use different receiving bands (that is, center frequencies of receiving bands are different), that is, different from receiving bands used by the third antenna A3 and the fourth antenna A4 of the second receiving unit 230 within a given distance, and receiving bands used by the first antenna A1 and the second antenna A2 of the first receiving unit 220 within a given distance.

Figure 13:
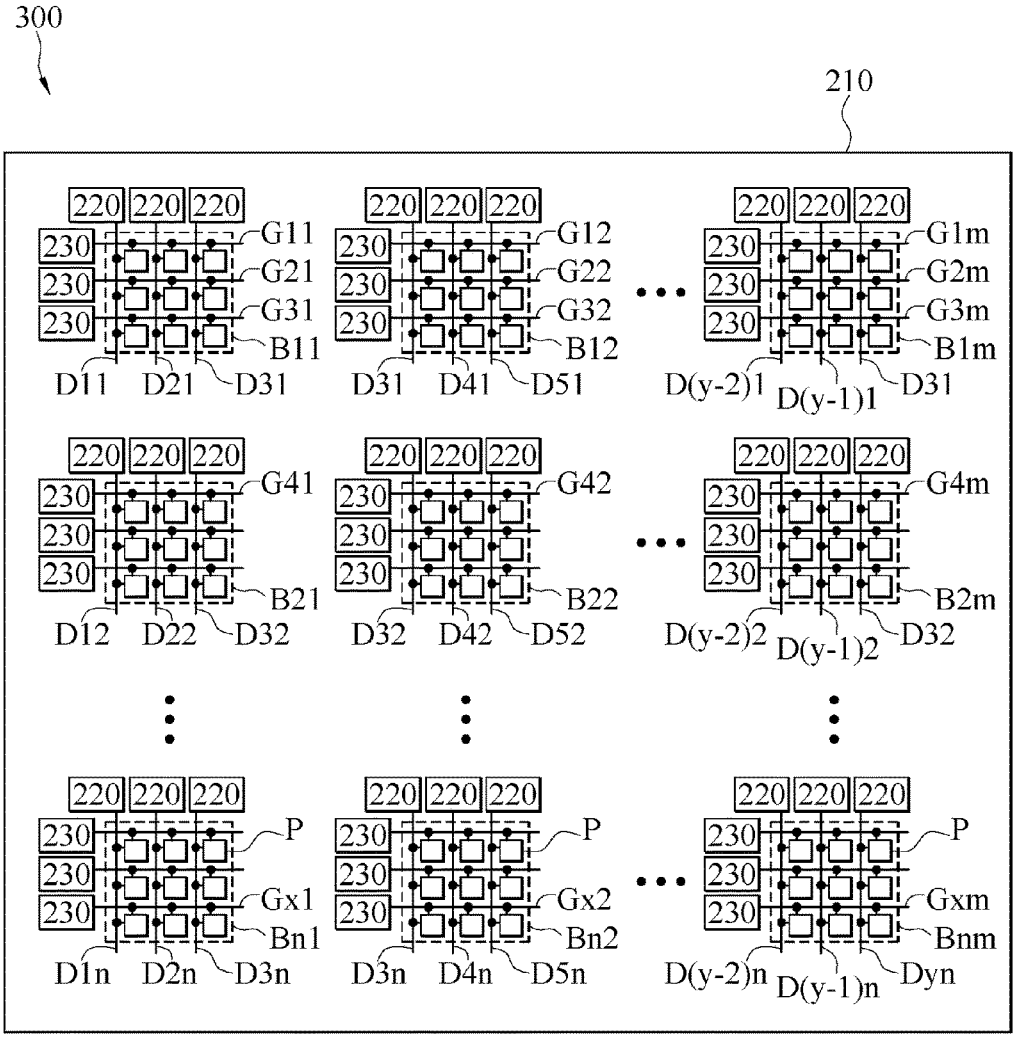
FIG. 13 is a schematic general view of another implementation aspect of a second embodiment of a pixel array structure.

FIG. 13 is a schematic general view of another implementation aspect of a second embodiment of the pixel array structure.

In an embodiment, data lines D1-Dy can be coupled to first receiving units 220 in a one-to-one manner. In another embodiment, a same data line Dy can be cut into a plurality of segmental data lines Dy1-Dyn, and each of the segmental data lines Dy1-Dyn is independently coupled to a first receiving unit 220, as shown in FIG. 12. The data lines D1-Dy may be cut into segmental data lines Dy1-Dyn with a same cutting quantity (that is, n of different data lines has a same value). In addition, the data lines D1-Dy may also be cut into segmental data lines Dy1-Dyn with different cutting quantities (that is, n of different data lines has different values). Or, a plurality of data lines in the data lines D1-Dy is cut into segmental data lines with a same cutting quantity, and there are at least two cutting quantities in the data lines D1-Dy (that is, n has two or more values). In an embodiment, scanning lines G1-Gx can be coupled to second receiving units 230 in a one-to-one manner. In another embodiment, a same scanning line Gx can be cut into a plurality of segmental scanning lines Gx1-Gxm, and each of the segmental scanning lines Gx1-Gxm is independently coupled to a second receiving unit 230, as shown in FIG. 12. The scanning lines G1-Gx may be cut into segmental scanning lines Gx1-Gxm with a same cutting quantity (that is, m of different scanning lines has a same value). In addition, the scanning lines G1-Gx may also be cut into segmental scanning lines Gx1-Gxm with different cutting quantities (that is, m of different scanning lines has different values). Or, a plurality of scanning lines in the scanning lines G1-Gx is cut into segmental scanning lines with a same cutting quantity, and there are at least two cutting quantities in the scanning lines G1-Gx (that is, m has two or more values).

In some embodiments, a same data line Dy may use a same cutting unit (for example, i has a same value), that is, quantities of scanning lines intersecting with the segmental data lines Dy1-Dyn in the same data line Dy are the same. In some other embodiments, there are at least two different cutting units (that is, i has different values) in the same data line Dy, that is, quantities of scanning lines intersecting with segmental data lines formed by different cutting units in the same data line Dy are different.

In some embodiments, a same scanning line Gx may use a same cutting unit (for example, j has a same value), that is, quantities of data lines intersecting with the segmental scanning lines Gx1-Gxm in the same scanning line Gx are the same. In some other embodiments, there are at least two different cutting units (that is, j has different values) in the same scanning line Gx, that is, quantities of data lines intersecting with segmental scanning lines formed by different cutting units in the same scanning line Gx are different.

In some embodiments, cutting units of the data lines D1-Dy may be the same as those of the scanning lines G1-Gx. In some other embodiments, cutting units of the data lines D1-Dy may be partially different or completely different from those of the scanning lines G1-Gx.

For example, the data lines D1-Dy are cut into the segmental data lines Dy1-Dyn with a same cutting quantity by using the same cutting unit (i); the scanning lines G1-Gx are cut into the segmental scanning lines Gx1-Gxm with a same cutting quantity by using the same cutting unit (j); and the cutting units of the data lines D1-Dy and the scanning lines G1-Gx are both 3 (i=3 and j=3), but the present invention is not limited thereto. Referring to FIG. 9 to FIG. 12, a pixel array 300 may comprise a plurality of pixel blocks B11-Bnm. Herein, scanning lines G1-Gx and data lines D1-Dy of the pixel blocks B11-Bnm do not share each other, that is, each of the pixel blocks (any one of B11-Bnm) is coupled to three segmental data lines and three segmental scanning lines. For example, the pixel block B11 is coupled to the segmental data lines D11-D31 and the segmental scanning lines G11-G13. In addition, the segmental data lines D11-D31 coupled to the pixel block B11 provide corresponding data signals to the pixel block B11, and the segmental scanning lines G11-G13 coupled to the pixel block B11 provide corresponding scanning signals to the pixel block B11.

In some embodiments, a first receiving unit 220 coupled to a plurality of segmental data lines and a second receiving unit 230 coupled to a plurality of segmental scanning lines within a given range receive respective corresponding wireless signals by using different receiving bands (data signals or scanning signals in a radio frequency form). In an embodiment, the pixel blocks B11-Bnm, the data lines D1-Dy, the scanning lines G1-Gx, the first receiving units 220, and the second receiving units 230 are disposed on the same substrate 310. The given range may cover all the first receiving units 220 and all the second receiving units 230 on the substrate 310. In addition, the given range may cover only some of the first receiving units 220 and some of the second receiving units 230 on the substrate 310.

In some embodiments, the gate drive circuit 140 in the pixel array structure 100 in the foregoing embodiments may also be replaced by the second receiving unit 230. Configuration and operating manners of the second receiving unit 230 are approximately the same as above, and therefore details are not described herein again.

Figure 14:
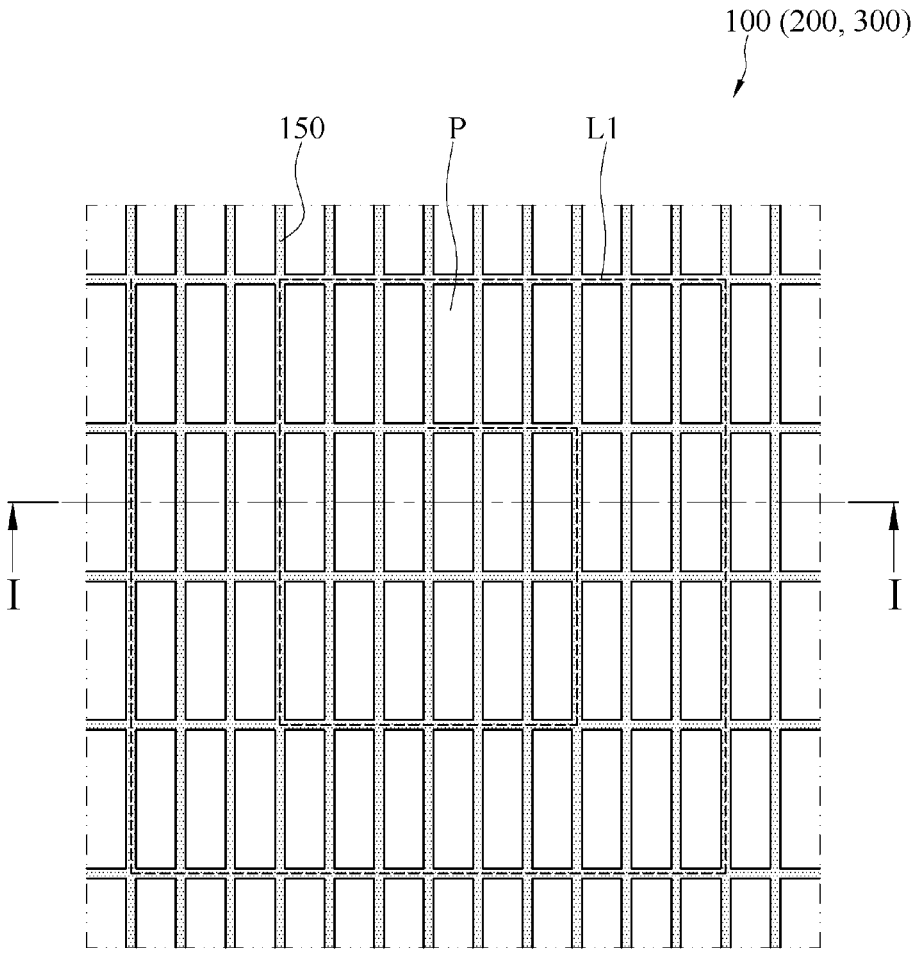
FIG. 14 is a schematic general view of a relationship between antenna layout wiring and a light shield pattern layer.
Figure 15:
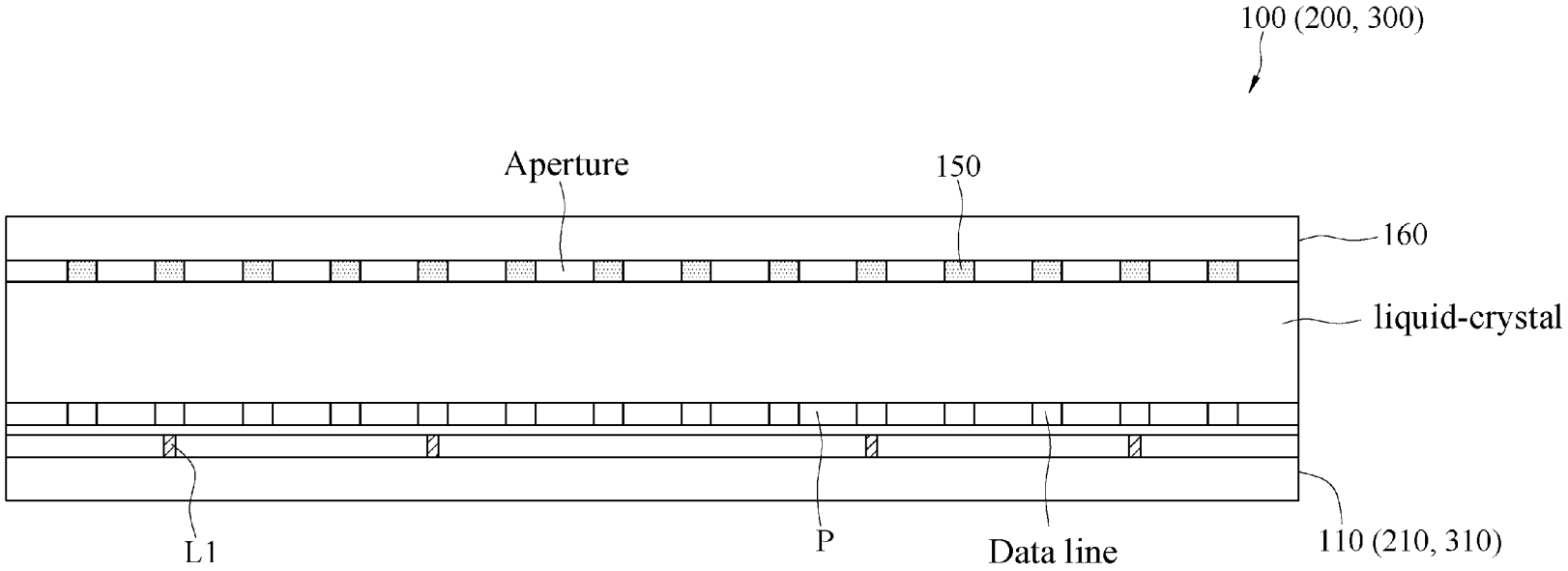
FIG. 15 is a schematic general view along a sectional line I-I in FIG. 14.

FIG. 14 is a schematic general view of a relationship between antenna layout wiring and a light shield pattern layer, and FIG. 15 is a schematic general view along a sectional line I-I in FIG. 14. Referring to FIG. 1 to FIG. 15, in some embodiments, the pixel array structure 100 (200 or 300) may further comprise a light shield pattern layer 150. The light shield pattern layer 150 may be configured to shield areas that are not used for display in the pixel array structure 100 (200 or 300).

In some embodiments, layout wiring L1 of each of the foregoing antennas (that is, the first antenna 121, the second antenna 124, the first antenna 125, the second antenna 126, the first antenna A1, and the fourth antenna A2) is overlapping with an orthogonal projection (a vertical projection is on the substrate 110) of the light shield pattern layer 150. In other words, the layout wiring L1 of each antenna may be shielded under the light shield pattern layer 150, so as not to affect an aperture opening ratio of a display panel having the pixel array structure (100, 200, or 300).

In some embodiments, the pixel array structure 100 (200 or 300) may further comprise an opposite substrate 160. The opposite substrate 160 is disposed opposite to the substrate 110 (210 or 310), and the light shield pattern layer 150 is disposed on the opposite substrate 160 adjacent to the substrate 110 (210 or 310). Under orthogonal projections of the light shield pattern layer 150 and pixel units P on the substrate 110 (210 or 310), the light shield pattern layer 150 is located on a periphery of each pixel unit P.

Based on the above, the pixel array structure of the embodiments of the present invention is applied to a display panel. Herein, the pixel array structure of the embodiments of the present invention can receive various data signals needed by various pixel units in corresponding pixel blocks by using various wireless receiving units in a wireless manner, so that the data signals needed by the various pixel blocks are not affected by an excessively large quantity of impedances. In addition, a pixel array apparatus of the embodiments of the present invention does not need to be additionally provided with data lines, and an aperture opening ratio thereof is still not affected after a display panel is manufactured subsequently, and the problem of insufficient placing space of data lines can also be improved. In some embodiments, the pixel array apparatus of the embodiments of the present invention can divide a display image of the display panel into a plurality of display areas, which can be updated at the same time, to increase consistency of the image. In some embodiments, according to the pixel array apparatus of the embodiments of the present invention, the display panel may not be provided with any driver integrated circuit (that is, a data drive circuit and/or a gate drive circuit), or a quantity of driver integrated circuits provided on the display panel is reduced, so as to implement a design of a slim border. When the pixel array apparatus of the embodiments of the present invention is applied to a large-size (greater than or equal to 65 inches) display panel, the problem of slowed signal state changing time caused by an insufficient driving capacity can also be reduced, so as to improve the reliability of the display panel.

The technical content of the present invention is disclosed through the foregoing preferable embodiments; however, these embodiments are not intended to limit the present invention. Various changes and modifications made by persons of ordinary skill in the art without departing from the spirit and scope of the present invention shall fall within the protection scope of the present invention. The protection scope of the present invention is subject to the appended claims.

What is claimed is:

1. A pixel array structure, comprising:

a plurality of scanning lines;

a plurality of pixel blocks, wherein each pixel block comprises:

a plurality of data lines;

a plurality of pixel units arranged in an array form, wherein each pixel unit is coupled to one of the plurality of scanning lines and one of the plurality of data lines;

a wireless receiving unit, configured to receive a data signal in a wireless manner wherein the wireless receiving unit comprises:

a first antenna, configured to receive the data signal; and a resetting unit, coupled between the first antenna and a position selection unit, and configured to reset the data signal according to a clock signal; and the position selection unit, coupled between the wireless receiving unit and the plurality of data lines, and configured to transmit the data signal to one of the plurality of data lines according to a position selection signal; and at least one second antenna, wherein each second antenna is coupled to more than one of the plurality of resetting units in the plurality of pixel blocks, and is configured to generate the clock signal in a wireless sensing manner, and provide the clock signal to the coupled plurality of resetting units.

2. The pixel array structure according to claim 1, further comprising a light shield pattern layer, wherein layout wiring of the second antenna is overlapping with an orthographic projection of the light shield pattern layer.

3. The pixel array structure according to claim 2, wherein layout wiring of each first antenna is overlapping with an orthographic projection of the light shield pattern layer.

4. The pixel array structure according to claim 1, wherein the wireless receiving unit further comprises:

a rectification unit, coupled between the first antenna and the position selection unit, and configured to rectify the data signal, and output the rectified data signal to the position selection unit.

5. A pixel array structure, comprising:

a plurality of scanning lines; and a plurality of pixel blocks, wherein each pixel block comprises:

a plurality of data lines;

a plurality of pixel units arranged in an array form, wherein each pixel unit is coupled to one of the plurality of scanning lines and one of the plurality of data lines:

a wireless receiving unit, configured to receive a data signal in a wireless manner; and a position selection unit, coupled between the wireless receiving unit and the plurality of data lines, and configured to transmit the data signal to one of the plurality of data lines according to a position selection signal;

wherein the wireless receiving unit comprises:

a first antenna, configured to receive a truncated signal;

a first transistor, wherein a first end of the first transistor is coupled to a power supply voltage, and is controlled by a clock signal;

a second transistor, wherein a first end of the second transistor is coupled to a second end of the first transistor; a second end of the second transistor is coupled to a ground voltage; and a control end of the second transistor is coupled to the first antenna; and a third transistor, wherein a first end of the third transistor is coupled to the position selection unit; a second end of the third transistor is coupled to a ramp voltage; a control end of the third transistor is coupled to the first end of the second transistor; the third transistor generates the data signal according to the truncated signal and the ramp voltage, and the data signal is output to the position selection unit by the first end of the third transistor.

6. The pixel array structure according to claim 5, wherein the wireless receiving unit further comprises:

a second antenna, coupled to the control end of the first transistor, and configured to generate the clock signal in a wireless sensing manner.

7. The pixel array structure according to claim 1, wherein the plurality of wireless receiving units of the plurality of pixel blocks receives the plurality of data signals by using receiving bands different from each other.

8. The pixel array structure according to claim 1, wherein the plurality of wireless receiving units of a plurality of adjacent pixel blocks in the plurality of pixel blocks receives the plurality of data signals by using receiving bands different from each other.

9. A pixel array structure, comprising:

a plurality of scanning lines;

a plurality of data lines;

a plurality of pixel units arranged in an array form, wherein each pixel unit is coupled to one of the plurality of scanning lines and one of the plurality of data lines;

a plurality of first receiving units, respectively coupled to the plurality of data lines, wherein the plurality of first receiving units respectively receives a plurality of data signals in a wireless manner by using different receiving bands; and a plurality of second receiving units, respectively coupled to the plurality of scanning lines, wherein the plurality of second receiving units respectively receives a plurality of scanning signals in a wireless manner by using different receiving bands.

10. The pixel array structure according to claim 9, wherein each first receiving unit comprises:

a first charging circuit, configured to generate a first charging signal according to a first sensing signal; and a first discharging circuit, configured to generate a first discharging signal according to a second sensing signal, wherein the data signals correspond to the first charging signal and the first discharging signal.

11. The pixel array structure according to claim 6, further comprising a light shield pattern layer, wherein layout wiring of the second antenna is overlapping with an orthographic projection of the light shield pattern layer.

12. The pixel array structure according to claim 11, wherein layout wiring of the first antenna is overlapping with an orthographic projection of the light shield pattern layer.

13. The pixel array structure according to claim 5, wherein the plurality of wireless receiving units of the plurality of pixel blocks receives the plurality of data signals by using receiving bands different from each other.

14. The pixel array structure according to claim 5, wherein the plurality of wireless receiving units of a plurality of adjacent pixel blocks in the plurality of pixel blocks receives the plurality of data signals by using receiving bands different from each other.

* * * * *